US005774557A

United States Patent [19]

Slater

[11] Patent Number: 5,774,557

[45] Date of Patent: Jun. 30, 1998

[54] AUTOTRACKING MICROPHONE SQUELCH FOR AIRCRAFT INTERCOM SYSTEMS

[76] Inventor: Robert Winston Slater, 48 W. 938 Chandelle, Hampshire, Ill. 60140

[21] Appl. No.: 506,365

[22] Filed: Jul. 24, 1995

[51] Int. Cl.[6] ..... H04R 29/00

[52] U.S. Cl. ..... 381/56; 381/110

[58] Field of Search ..... 381/86, 94, 92, 381/110, 120, 107, 95, 122, 57, 56

[56] References Cited

U.S. PATENT DOCUMENTS 4,941,187 7/1990 Slater ..... 381/86

5,563,952 10/1996 Mercer ..... 381/110

*Primary Examiner*—Curtis Kuntz

*Assistant Examiner*—Vivian Chang

*Attorney, Agent, or Firm*—R. Winston Slater

[57] ABSTRACT

An automatic adjusting threshold microphone squelch system for use in aircraft or other high noise environments including digital drop-out timer and voice detector connected directly to an analog composite signal processor. The processor is comprised of two channels including a microphone audio channel and an aircraft noise detection channel. The channels, driven from a common microphone, are arranged in parallel with the noise detector feeding its noise-dependent output forwardly to a variable-threshold microphone audio post-amplifier. The composite audio from this amplifier is automatically maintained below a first digital "zero" level when voice is absent while containing peaks above a second digital "one" level when audio is present. This composite audio directly feeds the digital detector/timer without further wave-shaping or other signal processing.

8 Claims, 1 Drawing Sheet

AUTOTRACKING MICROPHONE SQUELCH FOR AIRCRAFT INTERCOM SYSTEMS

Background of the Invention

The present invention relates to audio intercom systems for use in aircraft and other high noise environments and, in particular, to the microphone squelch or vox circuits used therein.

The field of aircraft intercoms and specific problems associated with the high noise aircraft intercom environment as well as other source integration problems are explicated in detail in applicant's prior U.S. Pat. No. 4,941,187, the contents thereof are hereby incorporated herein by reference.

In that specification it was disclosed that 'squelch' or 'vox' circuits (two generally interchangeable terms) are advantageously employed to automatically activate microphones (provided each aircraft occupant) upon the presence of an occupant's voice—otherwise, these circuits maintain the microphones in an "off" condition whereby the pick-up and amplification of aircraft cabin noise is avoided.

Aircraft squelch circuits are not new. Indeed, even at the time of applicant's original '187 development, squelch circuits were widely utilized. But until very recently, all known circuits were of the manual adjustment variety. In operation the voice activation threshold of these circuits had to be adjusted to assure proper turn-on when voice audio was present, but to minimize false activation in the absence of voice audio—such false activation being occasioned by reason of the relatively high noise levels found in many aircraft cockpits/cabins.

Manual adjustment was required in order to permit compensation for differing microphone types, different voice and user speech techniques, and changing aircraft cabin noise conditions. It is this latter 'variable' that renders the prior art manual squelch comparatively ineffective. One can 'set' a squelch threshold once for a given microphone type and user voice, but it is the ever-changing cockpit noise that often requires repeated squelch readjustment. (Noise changes, for example, due to different engine power settings, e.g. as required to climb verses descent, and due to different 'wind noise' which varies as a function of aircraft speed.) It is to solve the squelch threshold adjustment problem in variable noise environments that the present invention is directed.

A recent development, although not believed to be prior art, is the recently announced "automatic squelch" introduced by Sigtronics, Inc. of Covina, Calif. This squelch, however, is automatic only to the limited extent that when a button is pushed, the squelch completes its adjustment process without further user input, but at whatever aircraft noise level exists at that moment in time. This squelch does not automatically compensate for changing aircraft noise conditions and, as with the other manual squelches, requires repeated user input in order that the squelch remain properly adjusted as the aircraft cockpit noise changes. In short, this so-called 'automatic' squelch will still falsely trigger as the cockpit noise increases, unless the circuit is manually reactivated.

The squelch of the present invention is more than automatic, it real-time automatically tracks the noise and automatically readjusts its threshold as the noise changes, whether the noise is increasing or decreasing. Thus, no user input is required as the cockpit noise changes. This represents a major advance in squelch technology as the pilot is often—at such times when readjustment is required (e.g. upon applying full power for take-off)—completely occupied with other pressing tasks (i.e. one hand on the throttle, the other on the control yoke).

Squelches must respond substantially instantaneously when a voice 'appears' (i.e. so speech is not lost while waiting for the squelch to activate) and remain activated for a period of time (e.g. in the order of about 1 second) following any speech. This latter requirement that the squelch remain "on" is necessitated by the desire to avoid distracting microphone 'drop-offs' during inter-word and inter-syllable pauses which occur in ordinary speech.

The present invention utilizes a novel combination of analog and digital technology to achieve the above-described attack and release squelch intervals while, at the same time, providing the desired automatic adjustment and tracking features ("autotrack"). More specifically, and as further set forth hereinafter, the autotrack system employs real-time analog circuitry that provides an analog audio signal that represents the composite of aircraft noise and user voice as 'picked-up' by any given aircraft microphone. This composite signal is, importantly, characterized by a residual analog signal (generally corresponding to the aircraft noise) that has a peak amplitude below the trigger threshold (i.e. logical "1" level) for a selected digital logic family and by a voice-present analog signal that has a peak amplitude generally above said trigger threshold.

The composite analog signal is applied, in its analog form, to a trigger or reset input of a digital timer. The digital timer serves to instantaneously activate the corresponding aircraft microphone whenever the appropriate analog input exceeds the requisite logical "1" level and to maintain microphone activation for a predetermined interval following the last such logical "1" excursion of the analog signal. It will be appreciated that the digital timer, by reason of its interconnection to the analog automatic tracking circuitry, serves not merely as a 'timer', but importantly as a signal processor/Schmidt trigger to detect and 'square-up' the analog signal applied to the timer.

Numerous topologies were selected for use in the present analog automatic tracking system, including several off-the-shelf AGC amplifiers, but were found not to provide the requisite composite signal over the full amplitude range encountered in the aircraft environment (i.e. as a function of different aircraft and microphone types). In short, arrangements that were intuitively and initially considered appropriate, for example conventional feedback gain control (even when augmented by in-loop or post-feedback amplification) did not perform satisfactorily and had to be discarded. The present automatic tracking squelch system represents the culmination of literally dozens of unsatisfactory or outright failed attempts to solve the autotrack problem.

The automatic tracking system of the present invention utilizes a dual-channel, feed-forward arrangement wherein separate and substantially parallel paths are defined for the unprocessed microphone audio signal (that ultimately serves to trigger the digital detector/timer) and for the aircraft noise detector that defines a bias for the analog automatic tracking output amplifier/comparator. This arrangement has proven the most satisfactory and, when the various parameters that define the present squelch are properly chosen and balanced as set forth hereinafter, excellent autotracking results over a wide range of noise and microphone conditions.

The so-called unprocessed microphone audio path is that of quasi-conventional operational amplifier ("op amp") having a gain of about 100. This gain assures that aircraft microphone audio signals, that may exceed 500 mV peak, will readily drive this amplifier into "clip" (saturation). But this is not an ordinary op amp in the sense that it is not biased for, nor operated in, its linear region. Indeed, the operating point does not remain constant and may become more non-linear under increased aircraft noise conditions.

As noted, the audio output of the analog automatic tracking system is connected directly to a digital input of the squelch detector/timer. Specifically, it is the output from the above-noted op amp that drives the subsequent digital circuitry and, consequently, the nominal output of this amplifier (i.e. in the absence of a composite signal including voice audio) must be at a comparatively low level to avoid falsely triggering the digital detector/timer. Any 'low' level below the guaranteed maximum level for a logical "zero" condition may be selected. The precise operating point—in the absence of noise-induced threshold adjustment (discussed below)—is set by fixed bias to the positive input of the op amp.

Clearly a "zero voltage" bias point could have been selected and would have produced a high degree of 'immunity' against false triggering (essentially equal to the 'noise immunity' of the logic family selected). It will be appreciated, however, that the closer the output of the op amp is set to the maximum guaranteed 'low' signal level, the less 'additional' composite audio signal will be required to trigger the subsequent digital circuitry and, therefore, the more 'sensitive' the squelch will become. On the other hand, by setting this quiescent bias point too close to the trigger threshold, the likelihood of false triggering greatly increases.

As it was one object of the present invention to improve on overall squelch voice sensitivity (i.e. the ability to properly trigger the squelch on 'soft' voices or where the user fails to properly position the microphone close to the lips), a non-zero nominal bias point is preferred. Specifically, a bias point between about 0.5 and 1.5 volts is preferred for CMOS digital logic operated from a 8 volt DC source. This, in combination with the comparatively high gain of the op amp, results in excellent (low noise) microphone sensitivity.

But, as noted, such high sensitivity carries the concomitant risk of squelch falsing. To minimize this risk, two subsystems are employed in the present squelch. First, is the autotracking mechanism discussed below. This system serves to automatically lower the squelch microphone sensitivity in increased noise environments. But the autotracking system may not be completely satisfactory where the aircraft noise is comparatively low, for example, while the aircraft is operated at low power settings on the ground. Under these conditions, the microphone sensitivity may remain high enough to permit squelch triggering on random cockpit noises, e.g. the moving of aeronautical charts or the coupling of seat restraint system buckles etc.

Thus, a second and manual sensitivity adjustment subsystem is employed. This subsystem acts upon the positive op amp input and in concert with the aircraft noise detector/bias generator channel of the present automatic tracking squelch system. Specifically, and as discussed further hereinafter in connection with the noise detector/bias generator, the manual sensitivity control (when set to maximum sensitivity) and bias generator co-act whereby the above-discussed 0.5–1.5 volt op amp output bias point is achieved under zero or low noise conditions.

The noise detector/bias generator provides, as set forth below, a positive bias to the negative input of the op amp. This voltage increases as the aircraft noise increases. But under zero or low noise conditions, the bias generator, again in concert with the sensitivity control and, further, the op amp feedback resistance, provides a nominal 0.36 volts to the negative op amp input—this voltage being just slightly higher than the fixed bias supplied to the positive op amp input whereby the nominal 0.5–1.5 volt op amp output will be found.

The manual sensitivity adjustment is, itself, a voltage divider—the output from which is fed, through a specifically selected source resistance, to the aforesaid op amp negative input. This voltage divider is nominally adjustable from zero to about 0.78 volts. Similarly, the noise detector/bias generator is also fed through its own specifically selected source resistance to the same negative input. It will be apparent that the sensitivity source resistance serves both as a source of bias current as well as a 'sink' for bias current to the negative input depending on the adjustment of the sensitivity control and the level of aircraft noise.

As the sensitivity control is adjusted from its maximum sensitivity position (i.e. with the voltage divider set to zero volts and the sensitivity control source resistance therefore serving as a load or current 'sink' across the op amp negative input) to its minimum sensitivity position (i.e. with the voltage divider set to its maximum, e.g. 0.78 volts, and the source resistance serving a source of current), the op amp negative input correspondingly increases which, in turn, causes, first, the op amp output to decrease to cut-off (i.e. zero volts), then, as the negative input continues to increase, the op amp input is 'reverse-biased' whereby increasingly larger microphone audio signals, also applied to the ap amp negative input through the previously discussed first (or direct) parallel channel, will be required.

It will be appreciated that in this manner not only can the maximum sensitivity of the automatic tracking squelch system of the present invention be adjusted to avoid distracting false triggering at low noise (high microphone sensitivity) positions, but that the level of microphone audio required to trigger the squelch can be adjusted in the event that the degree of autotracking is not sufficient for a given aircraft/microphone combination. It should also be appreciated, as noted above, that for best autotracking squelch operation, an appropriate balance between the several interrelated parameters discussed is preferable.

This balance, finally, includes the aircraft noise detector/bias generator of the second parallel feed-forward channel. This channel includes a second op amp, again of comparatively high gain (e.g. 100), the output from which drives an integrator (through a diode) to produce a positive DC voltage generally corresponding to the noise.

The noise detector/bias generator, itself, represents a careful balance of both DC and audio/AC parameters. From the DC standpoint, the op amp is preferably biased to an output of 1.45 volts so that the final output presented to the negative input of the previously discussed first op amp (i.e. the output after passing through the diode and integrator and aircraft noise/bias detector source resistance)—and in concert with the sensitivity control and first op amp feedback resistance—provides the previously noted nominal first op amp output of 0.5–1.5 volts.

A second reason for having a comparatively low second op amp DC output level relates to the 'detector' function required of this noise detection channel, namely, that an increasing DC voltage level be generated in response to increasing noise. Thus, by reason of this low quiescent DC level, substantially all of the output swing of the second op amp is in the positive direction—the op amp is, in short, acting—in addition to its amplifying function—as its own rectifier.

The output diode serves to block the discharge of the integrator (through the second op amp output) between positive output peaks thereby resulting in the 'pumping up' of the integrator capacitor in accordance with both the peak amplitude of the second op amp output as well as the width of each of the output pulses. More specifically, due to the high gain of this second amplifier, noise may drive the output amplifier into clip at which point further increases in the detected/integrated noise voltage may still occur by reason of the increasing width of the clipped output pulses as the second op amp is driven harder into clip.

Notwithstanding, operation of this second op amp near or into clip when exposed to aircraft noise, only, advantageously desensitizes the aircraft noise channel against normal voice audio—this by reason that virtually all voice audio drives the second op amp into clip which, in turn, literally 'clips' the voice audio energy that would otherwise be present in an unclipped audio output waveform.

Although the second op amp output diode does preclude the discharge of the integrator capacitance through the op amp output, it does not function to convert the aircraft noise channel into a peak detector nor does it preclude the discharge of the integrator capacitance—this capacitor will still discharge through first op amp input circuitry including the previously discussed squelch sensitivity control.

Indeed, it will be appreciated that the aircraft noise channel must—to the greatest extent practical—respond to changing aircraft noise, but not to voice audio. This end is achieved through a combination of factors including the above-noted clipping action of the second op amp; the charging time constant of the integrator; and the 'discharge' impedance of the integrator. It has been found that a charging time constant of about 0.25 seconds coupled with an integrated discharge time constant of 0.5 seconds provides a sufficiently rapid response to changing aircraft noise conditions while minimizing the noise channel voltage change due to pure voice audio. More specifically, the amplitude 'envelop' found in ordinary speech results in relatively minor 'pumping up' of the integrated noise channel voltage during any given word or syllable while, in any event, permitting the discharge and return of the noise channel voltage toward its nominal noise-only level during the intervals defined between each speech 'envelop'.

The preceding paragraphs have described numerous of the interrelated elements comprising the dual-channel feed-forward automatic adjusting squelch system of the present invention. Hopefully the foregoing provides the reader with an understanding not only of the present autotracking squelch and its elements, but further, with an appreciation of the differences between, and advancement over, known prior art squelch systems.

It is an object of the present invention to provide a squelch system to enable aircraft microphones, or microphones in other high noise environments, whenever 'voice audio' is present thereon. It is an object that such squelch system provide improved voice sensitivity particularly during periods of relatively lower ambient noise as, for example, during 'taxing' of the aircraft. It is an object of the present squelch that the various microphones remain "off" (except during periods of voice presence) notwithstanding changing aircraft cabin/cockpit noise conditions. It is therefore a further object of the present invention that the squelch automatically respond to changing noise conditions and that the squelch automatically reduce the squelch microphone sensitivity as the cabin/aircraft noise increases so as to maintain the microphone in its "off" condition and, conversely, that the microphone sensitivity be increased as the cabin/aircraft noise decreases so as to maintain a higher level of voice sensitivity. It is a further object that the present squelch system remain cost-effective in comparison to existing squelch systems so that the advances and advantages taught herein may realistically be made available to the flying public (i.e. at a cost premium that does not so outweigh the operational advantages that the prior art systems are selected purely on cost grounds) and, to this objective, that certain comparatively inexpensive digital timer logic be utilized for, not merely its intended timing function (ire. to set the "on" duration of the squelch, once activated), but, additionally, that such digital logic be driven directly from the analog automatic tracking system whereby the digital logic serves to process such analog signals into digital signals thereby avoiding Schmidt triggers or other wave-shaping circuitry. And further to this end, it is an object that the analog automatic tracking system generate a composite noise/voice audio signal characterized in that the peak analog signal is below a predetermined threshold generally without regard to the level of the aircraft or other environmental noise and, further, that the composite audio signal is above a second, higher predetermined level whenever legitimate voice audio is present.

DESCRIPTION OF THE PREFERRED EMBODIMENT

Figure 1:
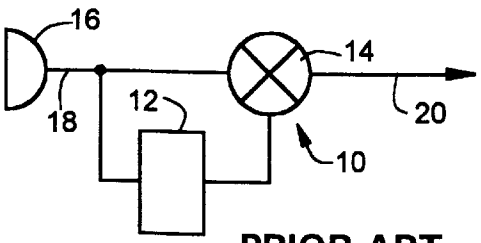
PRIOR ART FIG. 1
FIG. 1 is a block representation of an aircraft microphone squelch system of general form both as employed herein and by the prior art.

A generalized microphone squelch circuit 10 is shown in FIG. 1 and includes a microphone audio detector 12 interconnected to an electronic audio switch 14. An aircraft microphone, shown at 16 provides voice audio (as well as certain ambient aircraft cabin/cockpit noise 'picked-up' by that microphone) on line 18 in parallel to both detector 14 and switch 16. The presence of legitimate voice audio on line 18 triggers detector 12 which detector, in turn, enables switch 14 thereby passing the microphone audio to output 20. Audio 20 may thereafter be used as desired, for example, amplified to drive one or more aircraft crew or passenger headsets thereby enabling cabin/cockpit occupants to converse.

The above-described squelch 10 of FIG. 1 is of conventional form. Indeed the present squelch performs these same basic functions. However, this simplified prior art squelch does not reveal the whole story; namely, the difficulties associated with known audio detectors. It will be appreciated that the aircraft microphone outputs an audio signal that includes both voice audio and audio representative of the aircraft noise environment in which the microphone of necessity is located. Depending on the specific aircraft and microphone used, the noise component of the microphone output may not be insignificant (as compared with the voice audio component).

And while the voice audio may be predictable and repeatable, the aircraft noise is anything but. Aircraft noise is a function of many factors including wind noise (generally a function of aircraft speed) and engine power setting. Both aircraft speed and engine power vary dramatically over the range of permissible flight operations. For example, an aircraft taxing for take-off will exhibit relatively little speed-induced wind noise and relatively little engine noise—the power required for taxi operations being a fraction of that required during normal flight. During climb an aircraft may resort to full power and while in level, sustained flight will generally operate in the order of 65–75% power, but the noise associated with this slightly reduced power must be added to the substantial wind noise of an aircraft at cruise speeds.

Ordinary squelch voice detectors operate with a fixed detection threshold, that is, the signal level required to trigger the voice detection mechanism. If the threshold old is set to low, any increase in aircraft noise will falsely trigger the squelch. If, on the other hand, the threshold is set so as not to falsely trigger at the higher cabin/cockpit noise levels, normal speech may fail to reliably trigger the detector when such higher noise levels are absent. It is generally necessary, therefore, for the pilot to periodically readjust a conventional fixed threshold squelch in response to cabin/cockpit noise changes.

Figure 2:
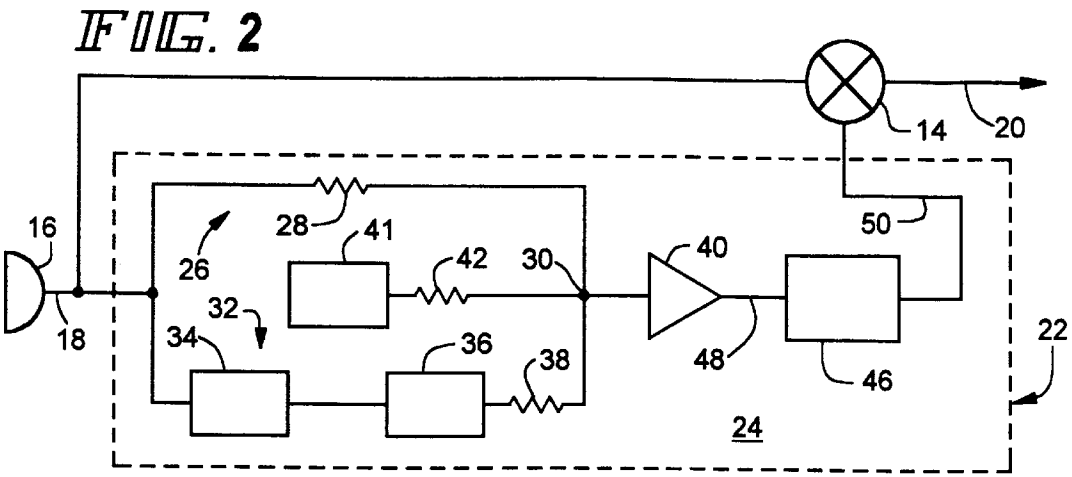
FIG. 2 is a block representation of the automatic tracking squelch of the present invention; and, FIG. 3 is a schematic representation of the automatic tracking squelch of FIG. 2.

FIG. 2 illustrates, in block form, the automatic adjusting or 'tracking' squelch 24 of the present invention in which the fixed audio threshold of the prior art squelch has been replaced by a constantly and automatically readjusting variable threshold squelch. The threshold corresponds and readjusts in response to, cabin/cockpit noise changes. It will be noted that microphone 16, microphone audio output 18, audio switch 14, and the switched audio output 18 remain unchanged between FIGS. 1 and 2 and have therefore been identically numbered in both figures. The autotracking system shown in the dashed box 24 of FIG. 2, however, replaces the prior art fixed detector 12 of FIG. 1.

The present autotracking system defines a dual-channel, feed-forward arrangement in which a first channel 26 feeds microphone audio, through an appropriate summing resistance 28 to summing junction 30. The second, and feed-forward, channel 32 is comprised of audio amplifier/detector 34 operatively connected to an integrator 36, thereafter, through a second summing resistance 38 to summing junction 30. A third summed input is defined by sensitivity control 41 and its summing resistance 42.

Figure 3:
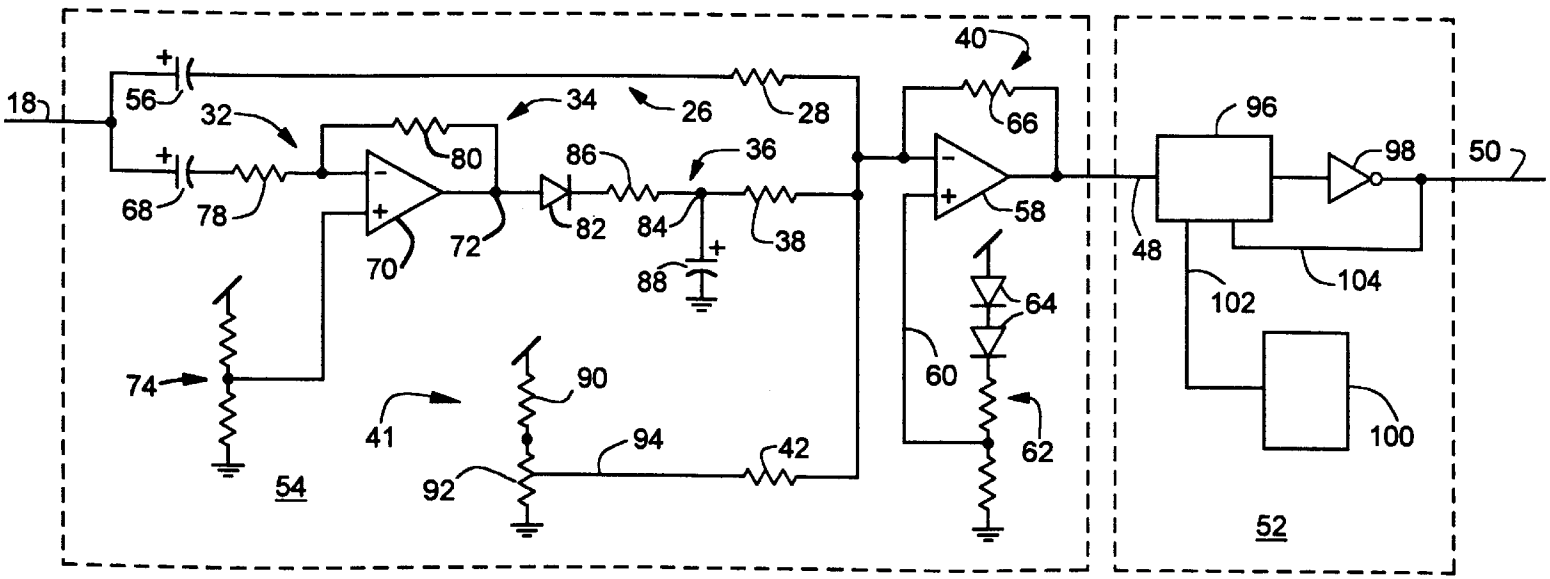

The above summed inputs preferably comprise the negative input of a conventional operational amplifier 44, the quasi-analog output therefrom is connected directly to a digital timer 46. Timer 46 advantageously serves in a dual capacity as a timer and as an analog signal processor and threshold detector. More specifically, the output 48 of amplifier 44 defines a composite audio signal having the characteristics of, first, a peak signal below a first predetermined level when no voice audio is present and, second, a peak signal above a second predetermined level when a voice audio signal is present. The first and second predetermined levels correspond, respectively, to the guaranteed maximum logic level "low" and minimum logic level "high" for the digital logic family selected for timer/detector 46. In the preferred embodiment conventional CMOS logic was selected due to its low power demand, its operating voltage flexibility, and its high input impedances. Specifically, as shown in FIG. 3, a 4520 counter and 4049 inverter combination performs as timer/detector 46.

In operation, whenever the composite audio signal at 48 exceeds the second predetermined level (corresponding to the presence of voice audio thereon), timer/detector 46 is triggered "on" for a preset period of time preferably in the order between 1.0 and 1.5 seconds. If timer 46 has been previously triggered "on" within such time period, the timed duration will be reset so that the microphone will remain "on" for the full 1.0–1.5 seconds following the last voice audio trigger signal.

The 1.0–1.5 second interval is sufficiently long to sustain a given microphone in the "enabled" mode even between syllables and words thereby avoiding distracting 'drop-outs' during normal speech patterns, yet, the duration is short enough not to be distracting. (Distraction may be caused by the continued noise pick-up of an enabled microphone and by the fact that microphone activation may cause muting of music and other inputs. For a further discussion of a preferred operative relationship between microphone, music, and aircraft communication audio inputs, see U.S. Pat. No. 4,941,187).

The output 50 from timer/detector 46 is connected to the gate input of audio switch 14 thereby connecting voice audio from microphone 16 to output line 20 whenever timer/detector 46 is triggered (as described above in connection with FIG. 1).

FIG. 3 is the schematic diagram for the automatic tracking voice detector system 24 (FIG. 2) of the present invention including digital timer/detector portion 52 and analog automatic tracking and composite signal generating portion 54.

As noted, autotracking portion 54 is comprised of first and second parallel channels 26 and 32 respectively. Channel 26 consists of capacitor 56 that functions to couple (i.e. block DC) the microphone audio 18 to a first input of operational amplifier ("op amp") 44. Amplifier 44 includes any general purpose operational or other high gain device 58, in the present case, an LM324. As set forth in the background section of the present specification, amplifier device 58 must be biased so that the quiescent DC level at the amplifier output 48 is below the first predetermined level thereby assuring that the subsequent digital timer/detector will not be triggered in the absence of valid voice audio present within the composite audio signal from amplifier 44.

For the present system in which the entire autotracking detector 24 is operated at 8 $V_{dc}$, and in which conventional 4000 Series CMOS logic is used for the timer/detector portion 52, the preferred quiescent DC output of amplifier 44 is between 0.5–1.5 $V_{dc}$ (when control 41 is adjusted from maximum sensitivity).

Again as set forth in the background to this specification, a balance exists between the various parameters of the present automatic tracking analog system whereby, for example, the above-noted preferred DC output level is, in fact, a function not merely of the DC bias potential at the positive input to device 58 but, further, of the biasing influences from the aircraft noise detecting channel 32 as well as the sensitivity adjustment 41. Notwithstanding, a DC bias potential of about 0.36 volts at positive input 60 has been found to produce excellent results. This potential is provided from a conventional voltage divider network 62 that has an impedance in the order of 5K ohms. Diodes 64 provide a degree of temperature compensation.

The first, or microphone audio, channel 26 defines a relatively high gain path through amplifier 44 whereby the composite output 48 therefrom shall be driven into 'clip' during normal voice audio thereby assuring proper triggering of the subsequent digital timer/detector 52. To this end, an amplifier 44 gain of 100 has proven satisfactory with amplifier feedback resistor 66 being 470K, microphone input resistor 28 being 4.7K, and, as noted, a positive biasing network impendance of about 5K.

Microphone audio 18 is also fed to the second or aircraft noise detection channel 32 through a second coupling capacitor 68. Capacitors 56 and 68 are 0.1 uf. Amplifier/detector 34 may, again, be any general purpose operational or other high gain device 70, in the present case an LM324 has been used. Amplifier 34 must be biased consistently with the requirements previously discussed concerning amplifier 44 (to which amplifier 34 is operatively interconnected through integrator 36), namely, that the quiescent output at 48 be within the range of 0.5–1.5 $V_{dc}$.

A further design objective and parameter of amplifier/detector 34 is to bias this amplifier sufficiently close to cut-off whereby any audio present on its input (i.e. coupled through capacitor 68) will drive the amplifier output at 72 substantially in the positive direction only whereby amplifier device 70 will serve a dual function of, first, amplifying and, second, detecting, i.e. producing a unipolar output representative of the magnitude of the input signal thereto.

To this end, a conventional voltage divider 74 provides a bias of about 1.45 $V_{dc}$ to the positive input 76 of device 70 which, in turn, biases the output 72 also to this 1.45 volt level.

Differing gains were attempted for amplifier/detector 34. In the end a relatively high gain of, again, about 100 was found to provide best results. This gain was required to produce a satisfactory change in the DC voltage level from the integrator 36 as a function of increasing aircraft noise while simultaneously minimizing the response of this feed-forward aircraft noise channel 32 to voice audio. In this latter regard, the clipping of voice audio by amplifier/detector 34 reduced the sensitivity thereof to such voice audio while continuing to provide proper detection of aircraft noise. Resistors 78 and 80 are, respectively, 4.7K and 470K. Voltage divider 74 uses 110K and 22K resistors to achieve the desired 145$V_{dc}$ bias.

The output 72 from amplifier/detector 34 is fed to integrator 36 through diode 82. Diode 82 blocks the reverse flow of current from integrator 36 between sequential audio cycles (i.e. peaks) thereby providing a DC potential at the integrator output 84 generally representative of the average, long-term aircraft noise. The integrator is comprised, first, of a single pole low-pass RC filter, including resistor 86 and capacitor 88 and, second, amplifier input resistor 38—this latter resistor functioning not only to set the initial DC bias and gain of amplifier 44 but to serve to discharge the integrator as discussed below.

Integrator 36 preferably defines an 'attack' time constant in the order of 0.25 seconds. To this end, resistor 86 and capacitor 88 may be, respectively, 100K and 2.2 uf. A 0.25 second time constant, in combination with the non-linear, high gain amplifier/detector 34 (i.e. in which voice audio is driven into clip), has been found to produce a DC output at 84 that is generally representative of the noise, but does not overly reflect or increase in response to voice audio.

Notwithstanding, some 'pumping-up' of the integrator DC output 84 may occur in response to ordinary speech. To minimize the deleterious effects of such 'pumping-up' (i.e. such effects being the reduction in squelch sensitivity caused by prolonged speech as opposed to pure aircraft noise), resistor 38 may advantageously be selected to perform the additional function of 'bleeding off' any DC integrator potential caused by voice audio pumping (it already sets the gain of amplifier 44 with respect to the DC noise output from integrator 36 as well as combining with the other negative and positive inputs to amplifier device 58 to set the required 0.5–1.5 volt quiescent level).

This latter function is rendered possible by reason of the nature of normal speech audio, namely, that individual words and syllables define 'envelopes' of audio spaced, generally, by momentary pauses. Thus, by selection of an appropriate 'bleed-off' time constant, these pauses may advantageously be employed to direct the return of the integrator to its pure noise DC level. In the present case, a bleed-off time constant in the order of 0.5 seconds was found satisfactory. Resistor 38 is 220K.

In conformity with one of the objectives of the present invention, the above-described automatic tracking squelch provides improved sensitivity, particularly in quieter environments where the gain has not been reduced by reason of the autotrack mechanism. However, this increased sensitivity occasionally promotes distracting false squelch activity by reason that any random non-voice noise—which in the past would not be of sufficient magnitude to trigger a conventional fixed threshold squelch—can be interpreted by the squelch as the on-set of legitimate voice audio. Therefore, it was determined that a means 41 for permitting individual users to manually set the ultimate squelch sensitivity would be desirable.

Still referring to FIG. 3, sensitivity control 41 defines a voltage divider comprised of fixed resistor 90 and potentiometer 92. Resistors 90 and 92 are, respectively, 47K and 5K thereby defining a sensitivity voltage adjustment range, at wiper 94, between zero volts and 0.78 volts. This voltage is applied to the negative input of device 58 through a 100K resistor 42.

Maximum squelch sensitivity occurs when the wiper 94 is at ground potential. In this position, resistor 42 shunts the negative amplifier 58 input to ground and, in combination with the previously discussed networks, results in the aforesaid desired amplifier 44 quiescent DC output of 0.5–1.5 volts. As the wiper 94 is advanced to its lesser sensitivity positions, the DC voltage at 94 increases to, as noted, 0.78 volts. At this point the voltage at the negative amplifier input will rise to about 0.74 volts thereby not only forcing the output 48 into cut-off (i.e. to zero volts), but, further, resulting in a positive/negative input differential in the order of 0.4 volts—which differential must be overcome in order to bring amplifier device 58 out of cut-off and to trigger the following digital timer/detector 52.

Digital timer/detector 52 is comprised of a counter 96, and inverter 98, and a clock oscillator 100. In the present embodiment, counter 96 is a CMOS 4520 four-bit counter, inverter 98 is a CMOS 4049, and oscillator 100 is a pair of cross coupled CMOS inverters, again, 4049's. Oscillator 100 is coupled to the clock input 102 of counter 96. The composite analog signal at 48 is coupled to the reset input of counter 96. Inverter 98 inverts and interconnects the output of the fourth counter flip-flop (i.e. $Q_4$ or $Q_d$) to the counter clock enable input 104.

In operation, the $Q_d$ output is "high" and the clock input is disabled. The timer/detector is in its non-detect/non-timing state. The microphone switch 14 (FIGS. 1 and 2) connected to the output 50 of the timer/detector 52 is "off" and no microphone audio is present on the audio output line 20. When the composite audio signal 48 exceeds the second predetermined level (i.e. the minimum guaranteed "on" logic level)—this level corresponding to the presence of a legitimate voice signal—counter 96 is reset (i.e. all Q outputs go to zero) and the clock enable input 104 goes "high" thereby enabling counter clocking. This resetting function will occur each time the input 48 exceeds the second predetermined level regardless of the current status of counter 96. Thus, if counter 96 is already enabled and in its counting sequence, the presence of the requisite signal on the reset input at 48 merely additionally resets the counter (to zero) thereby assuring that a full timed interval will follow the last voice audio detected.

Once enabled, clock 100 will continue to increment counter 96 until the $Q_d$ output is clocked "high" at which time clocking will again be inhibited awaiting the next voice audio reset signal at 48. This will occur on the eighth clock pulse. The period of the clock, therefore, should preferably be in the range of 150–225 milliseconds, or otherwise, to provide the desired squelch drop-out interval. Preferably this interval should be between 1–2 seconds.

Once triggered by the requisite analog signal at 48, timer/detector 52 operates largely independently of the analog portion of the automatic tracking system (we say "largely" as the timer may, as noted above, be retriggered at any time during its timing interval). Thus, no additional signal wave-shaping or processing is required —the timer provides fast rise and fall transitions consistent with the logic family selected. In this manner a cost effective interface is created between the analog and digital domains.

It will be appreciated that the above described timer/detector may be of any configuration. Different sized counters (i.e. of greater or fewer bits) and different clock frequencies may be employed. In fact, capacitively timed retriggerable single shots or microprocessor based timing may be employed.

While the preferred embodiments have been described, various alternative embodiments may be utilized within the scope of the invention which is limited only by the following claims and their equivalents.

I claim:

1. An automatic adjusting microphone audio squelch system for use in aircraft and other high noise environments including digital means for outputting a signal representative of the presence of valid voice audio from a microphone, the digital means having an input, the input defining a first signal input level whereby the digital means will not represent the presence of a valid voice audio signal so long as the input to the digital means remains below said first signal level and defining a second higher signal input level whereby the digital means will represent the presence of a valid voice audio signal so long as the input to the digital means exceeds said second signal level; means for generating a composite audio signal, said means including a microphone audio input adapted for connection to a microphone and a composite signal output, said signal output being connected to the input of the digital means, the generating means including means for automatically maintaining the composite output signal below said first signal level in response to an aircraft noise signal without voice audio on the microphone input and for automatically permitting the composite signal to exceed the second signal level when a voice audio signal is present on the microphone audio input whereby the squelch will automatically compensate for changes in the continuous aircraft or other environmental noise and maintain a microphone in its off condition and will, further, automatically enable a microphone when voice audio is present.

2. An automatic adjusting microphone audio squelch system for use in aircraft and other high noise environments including detecting means for outputting a signal representative of the presence of valid voice audio from a microphone, the detecting means having an input, the input defining a first signal level whereby the detecting means will not represent the presence of a valid voice audio signal when the input to the detecting means remains below said first signal level and defining a second higher signal level whereby the detecting means will represent the presence of a valid voice audio signal whenever the input to the detecting means exceeds said second signal level; means operatively connected to the detecting means input for creating signals at said first and second levels, said means including a microphone audio input, the creating means including first and second microphone audio signal processors each having an input operatively connected to the audio input; the first audio processor including a controllable threshold non-linear amplifier means further having a control input for adjusting said threshold whereby the microphone audio required to achieve said first detector level may be adjusted; the second audio signal processor including means for generating a signal generally representative of the microphone input noise, said representative noise signal being operatively connected to the control input of the non-linear amplifier whereby the threshold of said non-linear amplifier changes as the noise changes thereby maintaining the detector input signal below said first detector signal level when noise only is present on the microphone input and whereby the detector input signal will exceed the second signal level only when a voice audio signal is present on the microphone audio input thereby automatically compensating for changes in the aircraft or other environmental noise while maintaining a microphone in its off condition and, further, automatically enabling a microphone when voice audio is present.

3. The automatic adjusting microphone squelch system of claim 2 in which the detecting means includes digital means having a digital input whereby the first and second detecting means input levels are defined by the respective guaranteed low and high levels, respectively, for the digital means selected.

4. The automatic adjusting microphone squelch system of claim 3 in which the detecting means includes delay means for maintaining said representative valid voice output for a predetermined interval following each detecting means input signal above said second detector means input signal level; said delay means comprising digital counter means, the digital counter having an output and a reset input, the reset input defining the detecting means input whereby the output switches from a first signal level representative of no valid voice audio to a second signal level representative of valid voice audio whenever the signal on the reset input exceeds said second detector input signal level and remains at the second output signal level for the predetermined interval whereby said counter means serves both as the detector means and as the delay means whereby an inexpensive detector and delay timer is achieved without additional signal processing.

5. The automatic adjusting microphone squelch system of claim 2 wherein the first audio processor includes a first amplifier, the first amplifier being biased whereby audio on the microphone input drives the output of the amplifier substantially in one direction and wherein the gain of the amplifier is such that such driven output shall be clipped when microphone audio is present.

6. The automatic adjusting microphone squelch system of claim 5 including means for adjusting the amplifier bias whereby the level of microphone audio required to drive the amplifier into clip may be selectively adjusted whereby the sensitivity of a microphone connected to the microphone input may correspondingly be adjusted.

7. The automatic adjusting microphone squelch system of claim 2 in which the second audio processor includes a second amplifier, the second amplifier being biased whereby audio on the microphone input drives the output of the amplifier substantially in one direction and wherein the gain of the amplifier is such that such driven output shall be clipped at least when microphone audio is present.

8. The automatic adjusting microphone squelch system of claim 7 further including integrator means having an input and an output and diode means, the integrator means output operatively connected to first audio processor control input; the diode means operatively connected between the second amplifier and the integrator means input, the diode means serving to couple the amplifier output to the integrator means during audio peaks when the amplifier output is driven toward clip whereby the integrator means produces an output corresponding to the aircraft noise thereby automatically adjusting the first processor amplifier threshold to compensate for changes in the aircraft noise.

* * * * *